US006908279B2

(12) United States Patent
Sullivan et al.

(10) Patent No.: US 6,908,279 B2
(45) Date of Patent: Jun. 21, 2005

(54) METHOD OF INSTALLING STATIONARY BLADES OF A TURBINE AND TURBINE STRUCTURE HAVING A RADIAL LOADING PIN

(75) Inventors: Christopher Walter Sullivan, Ballston Spa, NY (US); David Orus Fitts, Ballston Spa, NY (US); Robert James Bracken, Niskayuna, NY (US); Gregory Lee Landry, Glenburn, ME (US)

(73) Assignee: General Electric Company, Schenectady, NY (US)

( * ) Notice: Subject to any disclaimer, the term of this patent is extended or adjusted under 35 U.S.C. 154(b) by 17 days.

(21) Appl. No.: 10/707,167

(22) Filed: Nov. 25, 2003

(65) Prior Publication Data

US 2005/0111973 A1 May 26, 2005

(51) Int. Cl.[7] ..... F01D 9/02

(52) U.S. Cl. ..... 415/191; 415/199.5; 415/209.3; 29/889.22

(58) Field of Search ..... 415/191, 199.5, 415/209.3, 211.2; 29/889.21, 889.22; 416/220 R

(56) References Cited

U.S. PATENT DOCUMENTS

| | | | | |
|---|---|---|---|---|
| 2,225,769 | A * | 12/1940 | Conrad | 416/216 |
| 4,175,755 | A | 11/1979 | Geary | |
| 4,819,313 | A | 4/1989 | Dadhich | |
| 5,088,894 | A | 2/1992 | Patel | |
| 6,722,848 | B1 * | 4/2004 | Couture et al. | 415/209.2 |
| 6,786,699 | B2 * | 9/2004 | Shapiro et al. | 416/216 |

OTHER PUBLICATIONS

Neumann et al; "Thirty Years Experience with Integrally Shrouded Blades"; 1989; pp. 1-8.

* cited by examiner

*Primary Examiner*—Ninh H. Nguyen
(74) *Attorney, Agent, or Firm*—Nixon & Vanderhye PC

(57) ABSTRACT

A wedge-like nozzle radial loading pin, preferably formed from steel, that contacts the bottom of a reaction nozzle along a graduated, that is inclined or stepped, surface. This contact will secure the reaction nozzle radially inward against the retaining surface of the carrier dovetail with sufficient force to maintain the designed airfoil pre-twist.

24 Claims, 3 Drawing Sheets

METHOD OF INSTALLING STATIONARY BLADES OF A TURBINE AND TURBINE STRUCTURE HAVING A RADIAL LOADING PIN

BACKGROUND OF INVENTION

The present invention relates to loading pins for reaction nozzles and, more particularly, to improved loading pin configurations for securing the reaction nozzles against the retaining surfaces of the carrier with sufficient force to maintain the design amount of twisting in the airfoil section.

A conventional turbine structure includes a rotor having a plurality of rotating blades (buckets) mounted thereto. The blades are mounted in rows to extend radially outward from an outer surface of the rotor. Typically, the blades in a given row are identical to each other but the rotating blades of one row will differ in length and/or shape from those of the other rows spaced therefrom. Each rotating blade has a foil portion that extends radially outwardly from the rotor and a base portion for mounting the blade to the rotor. To that end, the base portion includes a root received in a correspondingly shaped groove.

A stationary casing is coaxially supported around the rotor and has a plurality of stationary blades (nozzles) arranged in rows to alternate with the rows of rotating blades. All stationary blades include a foil portion extending from the inner surface of the stationary casing and a base portion including a root for being received in a corresponding groove of the stationary casing.

The root of the stationary blade and/or the groove of the stationary housing will be provided with a notch or recess to define a space between the root of the stationary blade and the groove. It is conventional to provide a caulking material or loading pin in the space defined by the notch and/or recess to interconnect the casing and root. Conventionally, the loading pin is formed from brass and is made by machining a surface onto a piece of round stock along its axis so that the pin has a constant cross-section that is generally "D" shaped along its entire length. Thus, conventional loading pins are straight with a machined surface parallel to the longitudinal axis of the pin.

SUMMARY OF INVENTION

Integral cover reaction nozzles have been designed to maintain an assembled pre-twist that we have recognized cannot be achieved with the previous, conventional nozzle radial loading pin designs. Thus, the invention provides a wedge-like nozzle radial loading pin, preferably formed from steel, that contacts the bottom of a reaction nozzle along a graduated, that is inclined or stepped, surface. This contact will secure the reaction nozzle radially inward against the retaining surface of the carrier dovetail with sufficient force to maintain the designed airfoil pre-twist. Two embodiments of the improved radial loading pin of the invention are described and illustrated by way of example herein below.

In a first embodiment, the graduated surface is defined as a continuous taper made by machining a substantially continuously inclined surface into a piece of round stock, along its axis, such that the cross-section through any point of the pin is shaped by the letter "D". The machined surface is made at an angle to the axis of the pin to create a substantially continuously tapered face that mates with a generally correspondingly tapered surface on the bottom of the reaction nozzle.

In an alternative embodiment, rather than a substantially continuous inclined surface, the loading pin comprises one or more discrete steps. More specifically, in an exemplary alternate embodiment, each end of the pin is machined generally parallel to the pin center line but at a different height from the pin centerline, creating two distinct surfaces and a length of machined surface at a slight angle is provided to interconnect the two flat machined surfaces.

Thus, the invention may be embodied in a method of installing stationary blades of a turbine comprising: arranging a plurality of stationary blades in a plurality of rows with each stationary blade of a row having a root and an airfoil portion, the stationary blades of a row being mounted by the roots in an annular groove provided in a turbine casing, each annular mounting groove having two opposite sidewalls and a bottom wall at least one of the root of the stationary blades and a wall of said mounting groove defining a recess; inserting a loading pin in the recess, between each said root and the groove, thereby keying the stationary blade root to the casing, said loading pin comprising a part-circumferential wall portion, generally corresponding in cross-sectional shape to cross-sectional shape of said recess, and a graduated wall portion, so that said pin is generally wedge-shaped.

The invention may also be embodied in a turbine structure comprising: a rotor having a plurality of rotating blades or buckets mounted thereto, the blades being mounted in rows to extend radially outward from an outer surface of the rotor; a stationary casing is coaxially supported around the rotor and having a plurality of stationary blades or nozzles arranged in rows to alternate with the rows of rotating blades, at least some of said stationary blades including a foil portion extending from an inner surface of the stationary casing and a base portion including a root for being received in a corresponding groove of the stationary casing; at least one of the root of the stationary blade and the groove of the stationary housing including a recess defining a space between the root of the stationary blade and the groove; a loading pin disposed in the space defined by the recess to interconnect the casing and root, said loading pin comprising a part-circumferential wall portion, generally corresponding in cross-sectional shape to cross-sectional shape of said recess, and a graduated wall portion, so that said pin is generally wedge-shaped.

BRIEF DESCRIPTION OF DRAWINGS

These and other features and advantages of this invention, will be more completely understood and appreciated by careful study of the following more detailed description of the presently preferred exemplary embodiments of the invention taken in conjunction with the accompanying drawings, in which.

DETAILED DESCRIPTION

Elastically pre-stressed blades installed under controlled conditions display excellent damping characteristic and are in the position of absorbing dynamic stresses under all operating conditions without endangering their long-term reliable life span. For blades with a sufficient amount of pre-stress, there is no frictional wear and no blade loosening. Therefore, it is important to maintain the prescribed pre-stress.

Thus, a design objective is that all installed blades are twisted inside the corresponding groove by a specific twist. The configuration of the nozzle airfoil and the dimensions of the root are selected so that the blade can assume the position inside the groove which is defined by the design criteria.

A loading pin provided in accordance with the present invention provides a wedge contact for radially loading the nozzle to secure the nozzle radially inward against the retaining surface of the carrier dovetail with sufficient force to maintain the designed airfoil pre-twist.

Figure 1:
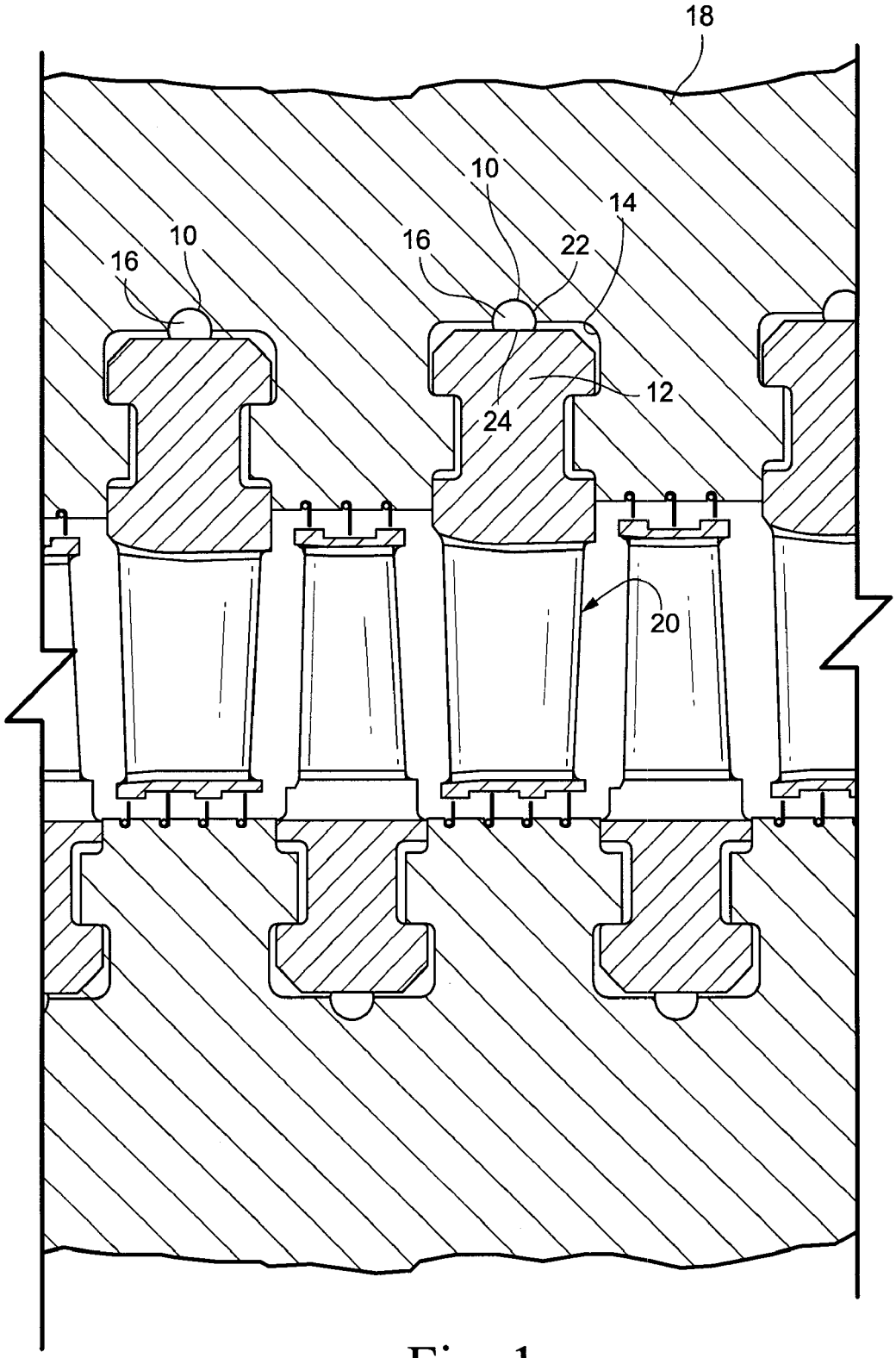
FIG. 1 is a schematic longitudinal section of stationary and moving blades of a turbine.

FIG. 1 schematically illustrates in longitudinal section two stages of a turbine structure. In the illustrated structure, a generally part cylindrical or U-shaped recess 10 is defined at the base of each nozzle root 12 receiving groove 14. A loading pin 16 is inserted into this recess between the casing 18 and the nozzle 20 for locking these parts with the nozzle in its pre-twisted disposition. To assuredly lock each nozzle and maintain its pre-twist, in an embodiment of the invention, the loading pin 16,116,216 is generally wedge shaped having a part cylindrical wall portion 22,122,222 and a graduated, i.e., inclined or stepped, wall portion 24,124,224.

Figure 3:
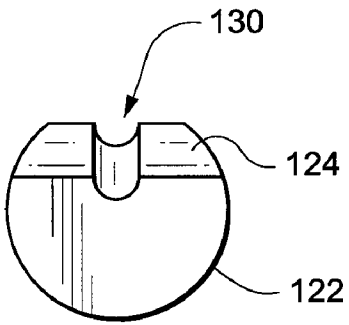
FIG. 3 is an end view taken from the right of FIG. 2.
Figure 2:
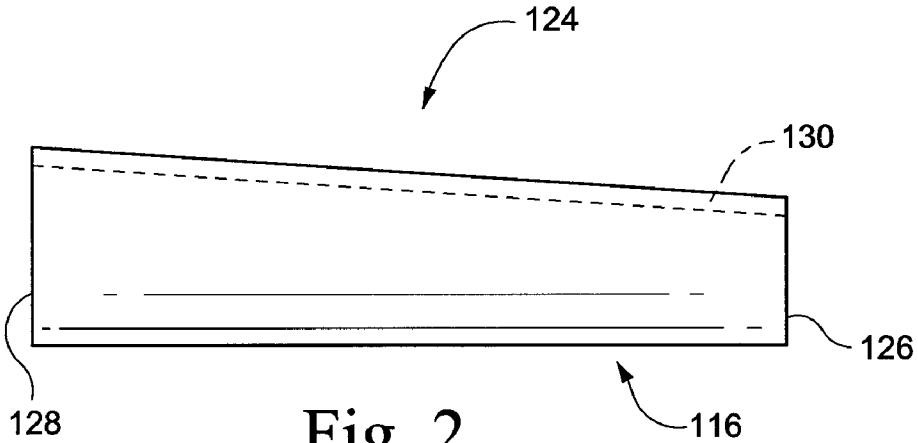
FIG. 2 is an elevational view of a loading pin provided in accordance with an exemplary embodiment of the invention.

In a first embodiment, illustrated in FIG. 2, the loading pin 116 has a wall portion 124 that is substantially continuously inclined from a first, insert end 126 to a second, proximal end 128 to define a generally tapered or wedge shaped pin 116. As will be understood from FIG. 3, the cross sectional area of the loading pin adjacent the distal, insert end is less than the cross sectional area of the loading pin adjacent said proximal end. Although wall portion 124 is illustrated as a continuously tapered surface, a wall portion comprising a plurality of steps so as to define an effectively continuously inclined surface would be functionally equivalent thereto.

A groove 130 is optionally defined longitudinally of the loading pin defining a part circular recess extending from the proximal to the distal ends of the pin. The groove allows the pin material to swage or upset from its original surfaces, thereby increasing the contact area between the pin and the nozzle. The groove also allows, e.g., insertion of a pin removal tool (not shown) so that the pin may be engaged and displaced proximally even if fully inserted below a respective nozzle 120. Although a part circular groove 130 is illustrated it is to be understood that the cross-sectional shape of this groove is non-critical and a V-shaped, rectangular or other groove configuration could be provided without departing from this invention.

As will be appreciated, the insertion of the tapered loading pin 116 illustrated in FIG. 2 into recess 110, between the nozzle root 112 and the root groove (carrier dovetail) 114 of the casing, lifts the nozzle slightly from the groove base. This will secure the reaction nozzle radially inward against the retaining surface of the carrier dovetail with sufficient force to maintain the designed airfoil pre-twist. To maximize the surface-to-surface contact between the loading pin and its respective nozzle(s), in an exemplary embodiment, a corresponding portion of the nozzle root 112 is machined to define an inclined surface 132 generally corresponding to the incline of the wall portion 124 of the loading pin 116 so that insertion of the loading pin yields an inclining surface to inclined surface wedge displacement. To ensure that the loading pin will maintain its shape and the corresponding lock of the nozzle with respect to the casing, in an exemplary embodiment, the loading pin is formed from steel.

Figure 5:
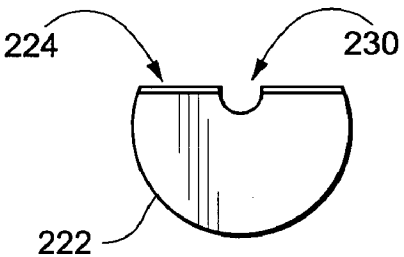
FIG. 5 is an end view taken from the right of FIG. 4.
Figure 4:
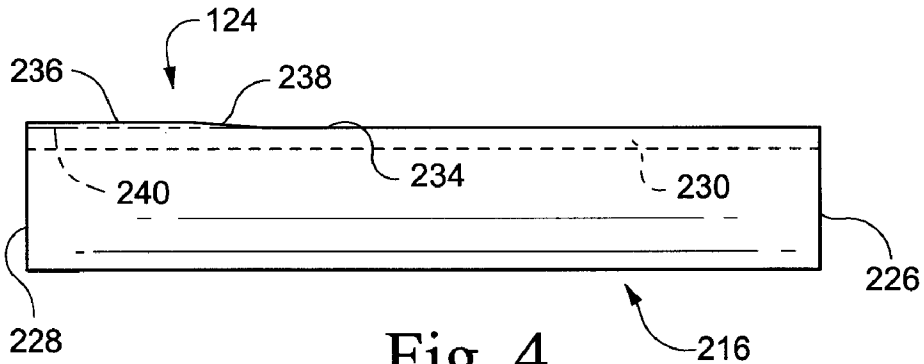
FIG. 4 is an elevational view of a loading pin provided in accordance with an alternate embodiment of the invention.
Figure 6:
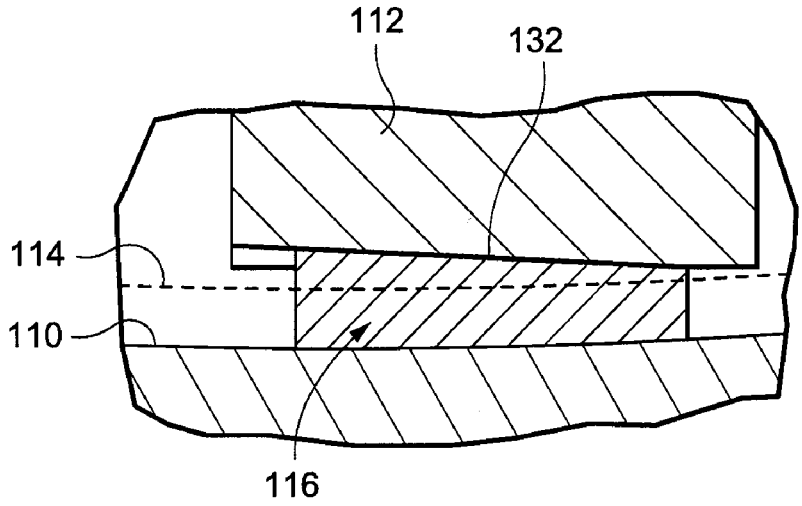
FIG. 6 is a cross-sectional view, looking down the turbine centerline, showing the pin of FIG. 2 installed between a nozzle and casing.
Figure 7:
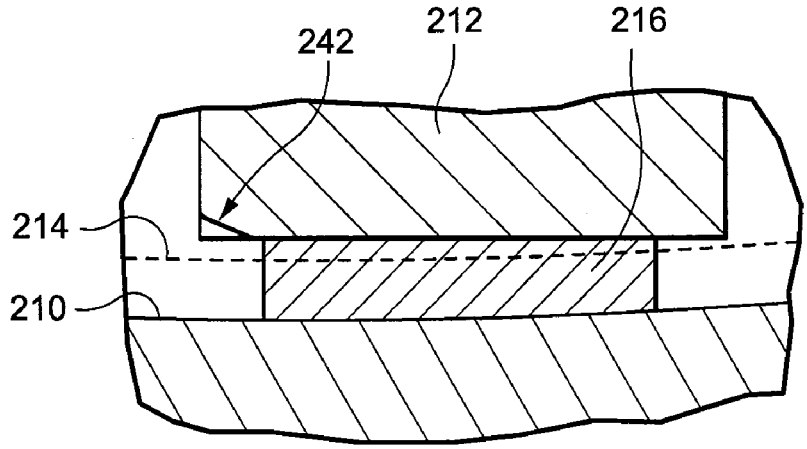
FIG. 7 is a cross-section view looking down the turbine centerline, the pine of FIG. 4 installed between a nozzle and casing.

An alternate embodiment of the invention is illustrated in FIGS. 4–5 and 7, rather than a tapered or substantially continuously inclined surface, wall portion 224 is comprised of discrete stepped portions. In the illustrated embodiment, a single step is defined along the length of the pin 216. More specifically, in this end, the pin is machined to define a flat nozzle engaging surface 234,236 adjacent each end 226,228, said surfaces being generally parallel to the longitudinal axis of the loading pin, and the loading pin 216 is machined to define an inclined transition or step 238 between the parallel surfaces 234,236. As illustrated by dashed line 240, the offset between flat surfaces 234,236 is limited. As also illustrated, a cutout 242 at the nozzle root may be provided to facilitate pin insertion.

A groove 230 is optionally defined longitudinally of the loading pin defining a part circular recess extending from the proximal end 228 to the distal end 226 of the pin 216. As in the first described embodiment, the groove 230 is provided to allow the pin material to swage or upset from its original surfaces, thereby increasing the contact area between the pin and the nozzle. The groove also allows, e.g., insertion of a pin removal tool (not shown) so that the pin may be engaged and displaced proximally even if fully inserted below a respective nozzle 212. As mentioned above, although a part circular groove 230 is illustrated for pin retrieval it is to be understood that the cross-sectional shape of this groove is non-critical and a V-shaped, rectangular or other groove configuration could be provided without departing from this invention.

As will be appreciated, the insertion of the tapered loading pin 216 illustrated in FIG. 4 into recess 210, between the nozzle root 212 and the root groove 214 of the casing, lifts the nozzle slightly from the base base of the dovetail groove 214 to effectively lock the nozzle in its prescribed pre-twisted configuration. Once again, to ensure that the loading pin will maintain its shape and the corresponding lock of the nozzle with respect to the casing, in an exemplary embodiment, the loading pin is formed from steel.

As noted above, it is to be understood that while a continuously inclined surface and a single stepped surface are illustrated as embodiments of the invention, the inclined surface need not be continuously inclined but can be provided as a series of discrete steps. Furthermore, the discrete flats 234,236 of the steps may themselves be provided as surfaces that are generally parallel to the longitudinal axis of the pin as illustrated in FIG. 4, or may be inclined themselves. Moreover, while in the illustrated embodiment, the transition 238 between discrete steps is provided as an inclined surface, it is to be understood that in the alternative, a plurality of discrete, generally perpendicular radial steps may be provided, whereby the cross-sectional area of the pin is increased from the distal end to the proximal continuously or in steps.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of installing stationary blades of a turbine comprising:

arranging a plurality of stationary blades in a plurality of rows with each stationary blade of a row having a root and an airfoil portion, the stationary blades of a row being mounted by the roots in an annular groove provided in a turbine casing, each annular mounting groove having two opposite sidewalls and a bottom wall at least one of the root of the stationary blades and a wall of said mounting groove defining a recess;

inserting a loading pin in the recess, between each said root and the groove, thereby keying the stationary blade root to the casing, said loading pin comprising a part-circumferential wall portion, generally corresponding in cross-sectional shape to cross-sectional shape of said recess, and a graduated wall portion, so that said pin is generally wedge-shaped.

2. A method as in claim 1, wherein said graduated wall portion is substantially continuously inclined from a first, insert end to a second, proximal end of said loading pin to define a said wedge-shape, a cross sectional area of said loading pin adjacent said insert end being less than a cross sectional area of said loading pin adjacent said proximal end.

3. A method as in claim 2, wherein said graduated wall portion is continuously tapered from said insert end to said proximal end.

4. A method as in claim 1, wherein a groove is defined longitudinally of the loading pin from proximal to distal ends of the loading pin.

5. A method as in claim 1, wherein said part-circumferential wall portion is part-cylindrical shaped.

6. A method as in claim 1, wherein said loading pin is generally D-shaped in cross-section.

7. A method as in claim 1, wherein said recess is defined in said wall of said mounting groove, and wherein a corresponding portion of the root of the stationary blade is machined to define a graduated surface generally corresponding to the graduated wall portion of the loading pin, whereby said inserting of said loading pin produces a graduated surface to graduated surface wedge displacement of said root with respect to said groove.

8. A method as in claim 1, wherein said loading pin is formed from steel.

9. A method as in claim 1, wherein said graduated wall portion is defined by at least first and second step surfaces respectively extending from a first, insert end of said loading pin and second, proximal end of said loading pin, said first step surface being closer to a central longitudinal axis of said loading pin than said second step surface.

10. A method as in claim 9, wherein an inclined transition surface extends between a plane of said first step surface and a plane of said second step surface.

11. A method as in claim 9, wherein said first step surface and said second step surface are each generally planar.

12. A method as in claim 9, wherein said first step surface and said second step surface are each generally parallel to a longitudinal axis of said loading pin.

13. A turbine structure comprising:

a rotor having a plurality of rotating blades or buckets mounted thereto, the blades being mounted in rows to extend radially outward from an outer surface of the rotor;

a stationary casing is coaxially supported around the rotor and having a plurality of stationary blades or nozzles arranged in rows to alternate with the rows of rotating blades, at least some of said stationary blades including a foil portion extending from an inner surface of the stationary casing and a base portion including a root for being received in a corresponding groove of the stationary casing;

at least one of the root of the stationary blade and the groove of the stationary housing including a recess defining a space between the root of the stationary blade and the groove;

a loading pin disposed in the space defined by the recess to interconnect the casing and root, said loading pin comprising a part-circumferential wall portion, generally corresponding in cross-sectional shape to cross-sectional shape of said recess, and a graduated wall portion, so that said pin is generally wedge-shaped.

14. A turbine structure as in claim 13, wherein said graduated wall portion is substantially continuously inclined from a first, insert end to a second, proximal end of said loading pin to define said wedge-shape, a cross sectional area of said loading pin adjacent said insert end being less than a cross sectional area of said loading pin adjacent said proximal end.

15. A turbine structure as in claim 14, wherein said graduated wall portion is continuously tapered from said insert end to said proximal end.

16. A turbine structure as in claim 13, wherein a groove is defined longitudinally of the loading pin from proximal to distal ends of the loading pin.

17. A turbine structure as in claim 13, wherein said part-circumferential wall portion is part-cylindrical shaped.

18. A turbine structure as in claim 13, wherein said loading pin is generally D-shaped in cross-section.

19. A turbine structure as in claim 13, wherein said recess is defined in said wall of said mounting groove, and wherein a corresponding portion of the root of the stationary blade is machined to define a graduated surface generally corresponding to the graduated wall portion of the loading pin, whereby said loading pin wedgingly locks said root with respect to said groove.

20. A turbine structure as in claim 13, wherein said loading pin is formed from steel.

21. A turbine structure as in claim 13, wherein said graduated wall portion is defined by at least first and second step surfaces respectively extending from a first, insert end of said loading pin and second, proximal end of said loading pin, said first step surface being closer to a central longitudinal axis of said loading pin than said second step surface.

22. A turbine structure as in claim 21, wherein an inclined transition surface extends between a plane of said first step surface and a plane of said second step surface.

23. A turbine structure as in claim 21, wherein said first step surface and said second step surface are each generally planar.

24. A turbine structure as in claim 21, wherein said first step surface and said second step surface are each generally parallel to a longitudinal axis of said loading pin.

* * * * *